United States Patent [19]

Wada

[11] Patent Number: 4,653,152

[45] Date of Patent: Mar. 31, 1987

[54] METALLIC CARD CLOTHING

[75] Inventor: Iwao Wada, Neyagawa, Japan

[73] Assignees: Nakagawa Seisakusho Mfg. Co., Ltd., Mie; Toyo Special Metallic Industry Co., Ltd., Osaka, both of Japan

[21] Appl. No.: 706,216

[22] Filed: Feb. 27, 1985

[30] Foreign Application Priority Data

Feb. 29, 1984 [JP] Japan ..... 59-35966

[51] Int. Cl.[4] ..... D01G 15/84

[52] U.S. Cl. ..... 19/114

[58] Field of Search ..... 19/114, 234

[56] References Cited

U.S. PATENT DOCUMENTS

| | | | |
|---|---|---|---|
| 2,731,676 | 1/1956 | Apthorp et al. | 19/114 |
| 3,204,297 | 9/1965 | Wada | 19/114 |
| 4,394,789 | 7/1983 | Egerer | 19/114 X |

FOREIGN PATENT DOCUMENTS

| | | | |
|---|---|---|---|
| 1484526 | 6/1967 | France | 19/114 |
| 974186 | 9/1963 | United Kingdom | 19/114 |

*Primary Examiner*—Louis K. Rimrodt
*Assistant Examiner*—J. L. Olds
*Attorney, Agent, or Firm*—Armstrong, Nikaido, Marmelstein & Kubovcik

[57] ABSTRACT

A metallic card clothing for use in a carding machine is produced by digging up at fixed intervals a plurality of regularly spaced projected ridges or one projected ridge formed on one flat surface of a steel strip thereby giving rise to a plurality of serrated component elements having a triangular shape in a plane as viewed in the longitudinal direction of the projected ridges and a lateral shape resembling the teeth of a saw. Owing to the specific shape of the needles formed in the component elements, this metallic card clothing excels in carding action and resistance to wear.

3 Claims, 19 Drawing Figures

METALLIC CARD CLOTHING

BACKGROUND OF THE INVENTION

1. Field of the Invention

This invention relates to a metallic card clothing for use in a carding machine.

2. Description of the Prior Art

Conventionally, the metallic card clothing in the carding machine used for the preparation of fibers in the spinning process has been produced by planting staples a, i.e. steel wires bent in the shape illustrated in FIG. 1 in a fillet b, i.e. a web formed of superposed layers of cotton cloth or felt as illustrated in FIG. 2 thereby forming a long needle belt (card clothing) and placing this needle belt to cover the rollers of the carding machine.

In the card clothing so constructed, however, since the acting angle $\alpha$ and the rear angle $\beta$ of the needles are parallel, fibers readily sink between the needles and the normal carding action (the action of arranging long fibers in one direction and removing short fibers and impurities) is not started until the sinking fibers c accumulate to a certain thickness. Thus, for the card clothing of this class, the sinking of fibers has always been an indispensable requirement. When the amount of sinking fibers increases excessively, however, the space intended for the carding action becomes excessively small. As the result, the card clothing experiences difficulty in effecting a normal carding operation. When the card clothing of this nature is used, therefore, becomes necessary to perform repeatedly an uneconomical cleaning work called "row cleaning" and, further, to give grinding to the card clothing. For this purpose, the carding machine must be stopped frequently and the working ratio of the carding machine is consequently lowered.

In the circumstance, the metallic card clothing which is produced by having a row of profile wires of an L-shaped cross section as illustrated in FIG. 4 each punched in a serrated pattern as illustrated in FIG. 3, thermally treating the pointed ends of the serrated edges, and wrapping the row of profile wires now containing hardened serrated edges around the rollers of the carding machine has come to find growing acceptance.

In the metallic card clothing so constructed, since the needles a' have a larger acting angle $\alpha$ than a rear angle $\beta$ and, therefore, possess a large included angle $\gamma$, the metallic card clothing exhibits quality and properties widely different from the card clothing having absolutely no included angle as illustrated in FIG. 1 and FIG. 2. As the result, the needle height $h_2$ of the metallic card clothing is notably smaller than the needle height $h_1$ of the aforementioned card clothing. This decreased needle height coupled with the improved properties mentioned above constitutes one of the major factors for elimination of sinking fibers. Generally, a decrease of needle height implies a proportional decrease of service life of needles by abrasion. Since the needle points of the metallic card clothing have no use for the bending step which is indispensable to the card clothing illustrated in FIG. 1 and FIG. 2, they can be hardened to a desired level by quenching and consequently prevented from accelerated wear. The fact that the needle height $h_2$ is relatively small does not matter very much. The metallic card clothing, accordingly, can withstand a protracted continuous service.

Since the metallic card clothing excels the conventional card clothing in terms of properties, quality of the product of carding, price, and the like, it has found widespread acceptance.

The appearance of synthetic fibers has posed a problem to bear upon effective use of these metallic card clothings; these fibers entangle themselves between the needles on the cylinder rollers and impede further progress of the carding operation. The synthetic fibers, because of their high friction coefficient, settle in the spaces intervening between the adjacent rows of needles and do not easily rise from the spaced. The synthetic fibers so deposited fast prevent the needles on the opposed sylinder rollers from effectively interacting. This phenomenon of clinging synthetic fibers impedes effective operation of the metallic card clothing.

For the prevention of this phenomenon, there may be conceived an idea of widening the acting angle of the needles or increasing the included angle of the needles on the cylinder rollers thereby preventing the fibers from settling to the intervening spaces. This idea, however, cannot be adopted because the increased working angle or included angle of the needles results in an impaired carding effect and a lowered quality of the product of carding.

It is the metallic card clothing illustrated in FIG. 5 and FIG. 6 that has been developed for the solution of this problem. This metalic card clothing comprises a row of profile wires rolled in an L-shaped cross section as illustrated in FIG. 6 similarly to the profile wires used in the conventional metallic card clothing, which profile wires are punched in a serrated pattern containing spaced needles a'' each forming a positive or acute acting angle $\alpha$ in the leading end portion and a negative or obtuse acting angle $\alpha'$ (not less than 90°) in the basal portion and, consequently, fulfilling two entirely different actions.

The operation of this metallic card clothing will be described below with reference to FIG. 7. A fiber impinging on the point O exerts a force $\overline{OA}$ upon the needle in consequence of the rotation of the cylinder roller. In accordance with the theory of vector, the force with which the fiber is drawn in is expressed as $\overline{OB}$. The needle, tends to draw the fiber into the space with the force of $\overline{OB}$. Incidentally, the space of the portion indicated by X in the diagram constitutes a space wherein the needle in question and the directly opposite needle on the other cylinder roller are allowed to interact amply. Any fibers falling in this space, therefore, are not suffered to entangle themselves in the intervening space and induce the phenomenon of fiber sinking. When a fiber is forced into the space indicated by Y in the diagram in consequence of excessive supply of fibers exerts a force of $\overline{O'A'}$ upon the needle. Again by the theory of vector, the force $\overline{O'A'}$ of the fiber acting at the point O' is resolved into the component forces $\overline{O'B'}$ and $\overline{O'C'}$. Consequently, the force $\overline{O'B'}$ is exerted upwardly entirely contrary to the aforementioned drawing force $\overline{OB}$. As the result, the rotation of the cylinder roller causes all the fibers in the space Y to be moved into the space X and subjected to the carding action of the card clothing. Thus, even the fibers which are liable to entangle themselves on the cylinder roller can be easily enabled to undergo the carding action.

The metallic card clothing constructed as described above offers an appreciable solution to the problem in terms of the function of a card clothing. The manufacture of this metallic card clothing remains to be rather difficult because it entails the step of punching the profile wires in the serrated pattern. It suffers from a major problem of heavy loss of material. The desirability of the appearance of a metallic card clothing enjoying high quality and excelling in resistance to wear finds mounting recognition as demands for increased machine speeds and improved productivity are gaining in impetus as experienced nowaday.

In the carding machine using the conventional metallic card clothing, an effort to improve productivity is liable to result in conception of an idea of increasing the total number of needles participating in the manifestation of the carding action where the individual needles possess a fixed amount of ability. In fact, the idea of increasing the number of needles per unit area by narrowing the pitches separating the individual needles or the intervals separating the rows of such needles has been already reduced to practise. Naturally, the combination between the pitches and the intervals separating the rows constitutes itself an important factor. When the density of the needles is increased randomly, there may ensue the problem of deposition of extraneous matter. There is another problem that the narrowed spaces between the needles render difficult desired plunge of needles into the web of fibers. Thus, the carding action of the card clothing is seriously impaired. The number of needles per unit area, therefore, is not allowed to increase past a certain level. Moreover, the increase in the number of needles turns out to be an immense addition to the work load involved in the conventional method for the manufacture of a metallic card clothing which comprises rolling thin round wires into profile wires and punching thin flat portions of the rolled profile wires in a serrated pattern containing teeth at a fine pitch. When the intervals separating the rows of needles are narrowed, the total length of the serrated profile wires to be wound on the cylinder rollers is all the more increased and the work involved becomes more troublesome. Thus, the manufacture of such profile wires and the attachment thereof to the cylinder rollers call for huge time and labor.

Since the conventional metallic card clothing is manufactured by the punching of rolled profile wires, it suffers from the disadvantage that the work is relatively difficult and it entails loss of material. It further has a problem pertaining to resistance to wear. Generally in the case of a rolled wire, fibrous carbide segments are distributed in the rolled wire in the direction of rolling. During the course of manufacture of a metallic card clothing as described above, the punching of the profile wire for the formation of needles inevitably entails severance of the aforementioned fibrous carbide segments. As the result, the fibrous carbide segments originating in steel wires are arrayed in the longitudinal direction of the metal card clothing (in the direction indicated by the arrow of a dotted line in FIG. 5) and the fibers act on the working surfaces of the needles (indicated by the symbol w in FIG. 5) in the direction in which the fibrous carbide segments are arrayed. The working surfaces of the needles, therefore, offer no ample resistance to wear and tend to wear off in a zigzagging pattern.

SUMMARY OF THE INVENTION

An object of this invention, therefore, is to provide a metallic card clothing which remedies all the drawbacks suffered by the conventional card clothing or metallic card clothing, possesses a high capacity for carding action, permits easy and inexpensive manufacture, and excels in resistance to wear.

Another object of this invention is to provide a metallic card clothing of high quality excelling in resistance to wear, which is produced easily without loss of material and without involving such molding means as the punching, for example, which is resorted to in the manufacture of the aforementioned conventional metallic card clothing.

In accordance with this invention, there is provided a metallic card clothing obtained by digging at fixed intervals a plurality of regularly spaced projected ridges or one projected ridge formed on one flat surface of a steel strip thereby giving rise to a plurality of serrated component elements having a triangular shape in a plane as viewed from the longitudinal direction of the projected ridges and a lateral shape resembling the teeth of a saw.

The other objects and characteristic features of the present invention will become apparent to those skilled in the art as the disclosure is made in the following description of a preferred embodiment of the invention, as illustrated in the accompanying drawings.

BRIEF DESCRIPTION OF THE DRAWING

FIG. 1 (B) is a side view of FIG. 1 (A);

DETAILED DESCRIPTION OF THE INVENTION

In the carding of fibers, the first consideration on performance should be given to the abilities of the card clothing wrapped around the cylinder roller. Once the problem on the performance of the needles on the cylinder roller is solved, the problem regarding the needles on the other rollers will be easily solved.

The main abilities expected of the needles on the cylinder roller may well be considered to be:

(a) The ability to take full hold of fibers, effect efficient carding action thereon, and convey them, and (b) The ability to effect perfect transfer of fibers from the cylinder roller to the doffer.

Figure 5:
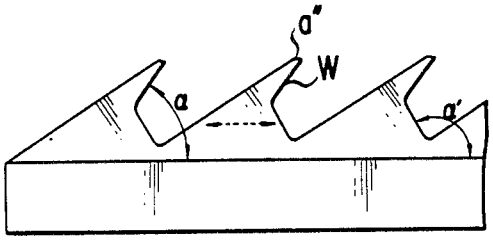
FIG. 5 is a side view illustrating an improved serrated profile wire of improved design for use in the conventional card clothing.
Figure 6:
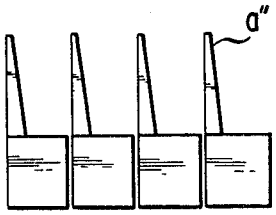
FIG. 6 is a front view illustrating a multiplicity of serrated profile wires of FIG. 5 arranged parallelly and contiguously.
Figure 7:
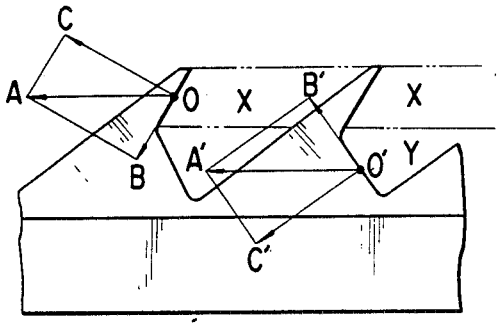
FIG. 7 is a schematic diagram for illustrating the carding action produced by the serrated profile wire of FIG. 5.

The aforementioned requirement of (a) is believed to have been fulfilled by introducing the theory of the negative angle to the acting angle of needles as illustrated in FIG. 5 through FIG. 7. As concerns the requirement of (b), the conventional metallic card clothing constructed as described above manifests the ability to a fair extent in the sense that it is capable of holding fibers close to the surface of the cylinder roller and therefore permits transfer of fibers. This ability, however, falls short of sufficiently fulfilling the requirement. The reason for this shortcoming is that it has been customary to consider the shape of needles as viewed exclusively laterally relative to the direction of advance of the needles.

Figure 1:
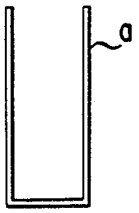
FIG. 1 (A) is a front view of a needle in the conventional card clothing.
Figure 1:
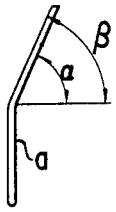
Figure 2:
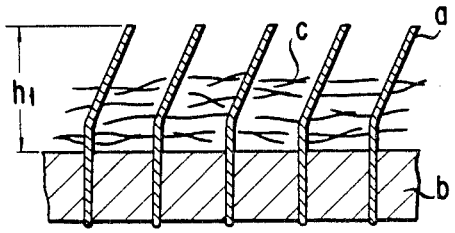
FIG. 2 is a longitudinal cross section of the conventional card clothing.
Figure 3:
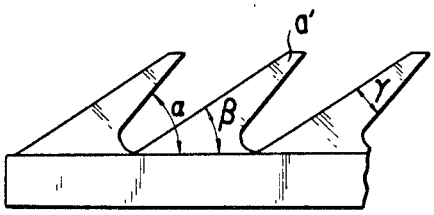
FIG. 3 is a side view of a serrated profile wire for use in a conventional metallic card clothing.
Figure 4:
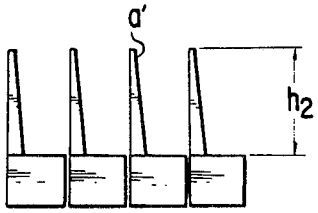
FIG. 4 is a front view illustrating a multiplicity of serrated profile wires of FIG. 3 arranged parallelly and contiguously.

In the ordinary card clothing or in the metallic card clothing heretofore known to the art, the needles in the cross-sectional view taken in the direction of travel are arrayed parallelly or substantially parallelly as shown in FIG. 1 (B), FIG. 4, and FIG. 6. In the conventional card clothing or metallic card clothing, therefore, no consideration whatever has been given to the shape of needles as viewed in the direction of travel, i.e. in the plane of carding action. According to the study made by the inventor, it has been ascertained to him that the shape of needles as viewed in the plane of carding action has a significant bearing upon the aforementioned ability. To be specific, it has been demonstrated that the aforementioned requirement is fulfilled best when the cross-sectional shape of needles as viewed in the plane of carding action is a triangle.

It has also been ascertained to the inventor that for the improvement of the needles in terms of resistance to wear, it is imperative that the fibers should be enabled to act on the needles perpendicularly to the direction of arrangement of fibrous carbide segments in the steel material of the serrated component elements. For the formation of the serrated component elements in the metallic card clothing of this invention, therefore, such means as punching which has been prevalently resorted to heretofore is not adopted and a method of digging up projected ridges on one surface of a steel strip is employed instead.

The term "steel strip" as used in this specification is to be interpreted as embracing steel plates, ribbons, strips, and wires of the type which permits formation of needles as contemplated by this invention.

Figure 8:
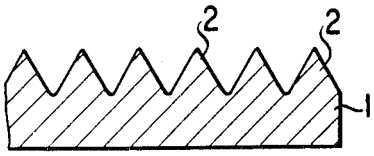
FIG. 8 (A) and (B) are longitudinal cross sections illustrating two versions of component elements for a metallic card clothing of the present invention.
Figure 8:
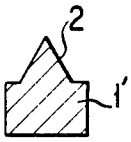
Figure 9:
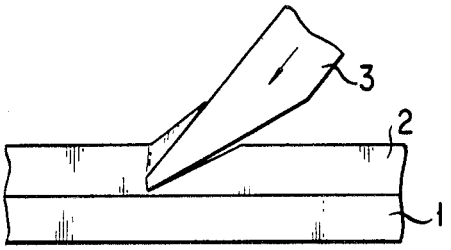
FIG. 9 is a schematic diagram for illustrating the manner in which the component elements of FIG. 8 (A) and (B) are formed.
Figure 10:
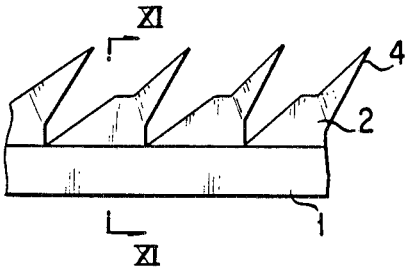
FIG. 10 is a side elevation illustrating a typical serrated component element for use in the metallic card clothing of the present invention.
Figure 11:
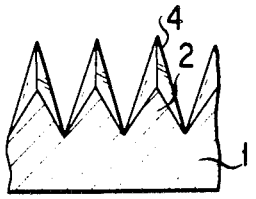
FIG. 11 is a cross-sectional view taken through FIG. 10 along the line XI—XI.

First, a typical method used for the manufacture of a metallic card clothing of this invention will be described. A steel strip 1 having a plurality of projecting ridges 2 arrayed as spaced, preferably regularly, on one surface as illustrated in FIG. 8 (A) or a steel strip 1' having one projected ridge 2 formed on one surface as illustrated in FIG. 8 (B) is used as the starting material. When the projected ridges 2 of the steel strip 1 are cut and raised with a sharp blade 3 inserted aslant downwardly as indicated by the arrow into the projected ridges in the longitudinal direction as illustrated in FIG. 9, there is formed a row of needles 4 whose acting faces, i.e. the faces viewed in the direction of travel as illustrated in FIG. 11, are in a triangular shape. By repeating this digging at fixed intervals in the direction of the length of the projected ridges, there is formed a card clothing which comprises arrayed serrated component elements having a lateral shape resembling the teeth of a saw as shown in FIG. 10 and an acting surface of a triangular shape as described above. The only portions of the serrated component elements that form needles (4 or 2, additionally) are hardened by quenching before the card clothing is wrapped around the cylinder roller, etc. of the carding machine and put to use. As concerns the lateral shape of the needles so formed, the acting angle in the acting surface of the needles is only required to be an acute angle as illustrated in FIG. 10. The acting angle of the same needles in their basal portion is desired to be an obtruse angle.

Now, the operation of the metallic card clothing of the aforementioned construction used as wrapped around the cylinder roller will be described below.

Figure 12:
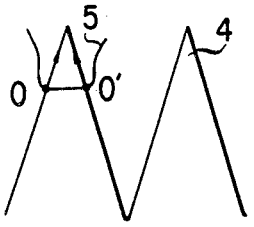
FIG. 12 and FIG. 13 are schematic diagrams for illustrating the carding action produced by the serrated component element illustrated in FIG. 10.
Figure 13:
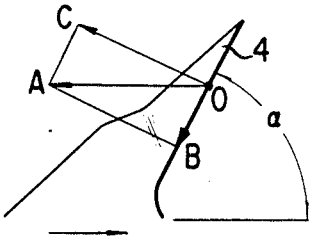

FIG. 12 is a diagram showing needles of the present invention as viewed in the direction of travel (diagram of acting surface), with one fiber 5 acting on one such needle. FIG. 13 is a side view of such needles. As the needle 4 advances in consequence of the rotation of the cylinder roller, the fiber 5 acts on the points O and O' of the needle 4 and, consequently, is dragged by a force of $\overline{OA}$. In accordance with the theory of vector, the force expressed as $\overline{OA}$ produces a component force of $\overline{OB}$ directed downwardly. Actually, the fiber is subject to a similar action at the point O' on the opposite surface. Thus, the fiber tends to remain intact unless it deviates from either of the points mentioned above. Further since the acting surface is in a triangular shape, a force directed upwardly toward the acute angle (in the direction indicated by the arrow in FIG. 12) acts on the fiber. The fiber 5, therefore, has no possibility of sinking into the intervening space even when the acting angle $\alpha$ is less acute than the countertype angle in the conventional card clothing. By thus forming the acting angle $\alpha$ of the needles in an acute angle, the needles are enabled to take safe hold of fibers and cooperate with the opposite needles (i.e., the needles of the walker and the needles of the top card clothing) to give rise to an extremely vigorous carding action. In this case, the failure of the needles to catch hold of the fibers can be one cause for the occurrence of neps and can eventually result in degradation of the quality of the product of carding and in decrease of yield. In this respect, the metallic card clothing of this invention is ideal in the sense that it has no possibility of giving birth to neps.

Figure 14:
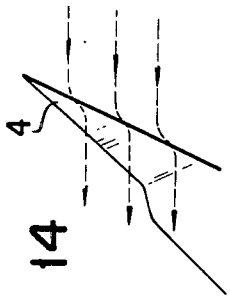
FIG. 14 is a schematic explanatory diagram for illustrating the condition in which air current flows along the serrated component element of the metallic card clothing of the present invention.

The needles have a flat front surface (acting surface) as illustrated in FIG. 14. Thus, they sufficiently interact with the air current caused in consequence of the rotation of the cylinder roller. When the air collides with the acting surface of the needle and then flows away along the opposite lateral sides of the needle as shown in by the arrows in the diagram, it greatly aids in the separation of impurities from the fibers. The liberation of such impurities is facilitated because the tip of the needle is fine enough pass smoothly through fibers. Moreover, the air which has once sunken into the intervening space is enabled by the needle to flow away as indicated by the arrows, the flow of the air coupled with the centrigal force generated by the rotation of the cylinder roller aids the fiber in floating up and departing from the intervening space. This phenomenon goes to enhance the carding action of the card clothing. Further, the surface area at the tip of the needle in the card clothing is extremely small as described above, the surface area of the space opposed to the acting surface of the needle is proportionately large. This largeness of the surface area of the acting surface coupled with the high acuteness of the acting angle facilitates perfect reception of fibers and, at the same time, facilitates the discharge of removed impurities. As the result, the sliver produced by the carding operation enjoys notable improvement of quality.

Figure 15:
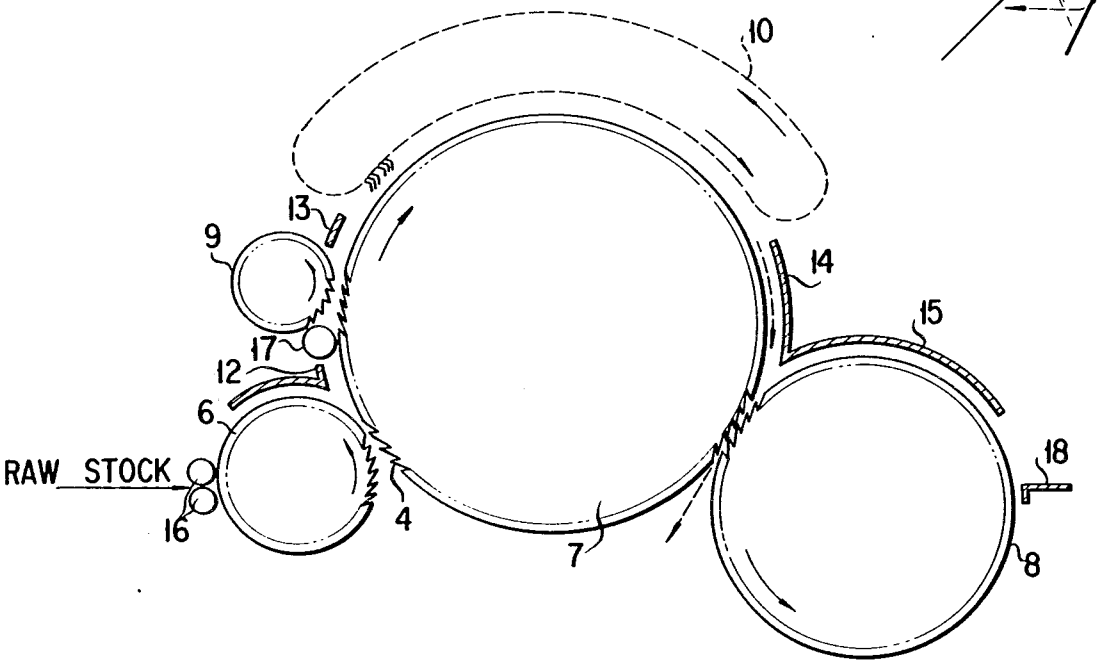
FIG. 15 is a schematic diagram illustrating the construction of a carding machine which combines a flat card and a walker roller.

FIG. 15 is a schematic diagram illustrating a carding machine which combines a flat card and a walker roller. Now, the cooperative action which the carding machine produces in conjunction with the cylinder roller using the metallic card clothing of the present invention will be described below.

With reference to FIG. 15, a raw web of fibers supplied via feed rollers 16 and delivered by a taker-in roller 6 is amply caught by the needles 4 of powerful acting angle in the metallic card clothing on the cylinder roller 7 and is made to interact with the needles on the walker roller 9. In this case, since the action of the needles 4 on the cylinder roller 7 is powerful, the needles on the walker roller 9, for the purpose of fully corresponding the needles 4, are desired to have a rather large height and a sufficiently acute angle for their acting angles and, consequently, acquire an ability to catch ample hold of fibers on the surface of the walker roller 9. At times, the needles on the two rollers divide the fibers proportionately to their respective levels of ability and effect their own carding actions on the divided portions of fibers. The walker roller 9, so to speak, is advantageous in fulfiling the roll of pooling temporarily any excess of fibers occurring on the surface of the cylinder roller. Thus, it is believed to be discharging an important roll of smoothening the carding action to be brought about in conjunction with the subsequent top card clothing. While the web of fibers is riding on the walker roller 9, it is not allowed to interact with the cylinder roller 7. Thus, the walker roller 9 constitutes itself a safety zone in which the fibers are not damaged for any useless cause. The tips of the needles 4 on the cylinder roller 7 have an extremely small furface area and, therefore, the spaces intervening between the needles are large and produce a sensitive action. When the needles 4 on the cylinder roller 7 have unfilled room, they continue to receive fibers from the needles on the walker roller 9 through the medium of the stripper roller 17. In this stage, therefore, the distribution of fibers on the cylinder roller 7 is believed to be fairly uniformized.

Then, the fibers on the cylinder roller 7 are subject to the action of the top card clothing. To be specific, the cylinder roller 7 and the top card clothing 10 interact each other and the degree of the carding action effected on the fibers on the cylinder roller 7 continues to grow. When there is room, the fibers immediately continue to advance while extracting long fibers retained on the top card clothing. When the metallic card clothing of this invention which has powerful acting angles is used as a card clothing for the cylinder roller 7, since the carding action derived therefrom is powerful, the carding action and the transfer effected on the fibers are ideal. Since the metallic card clothing of this invention has needles of the specific shape as described above, the action of air current is carried out quite vigorously as described above. Especially short fibers and impurities are in shapes virtually incapable of being caught between the needles and, therefore, are separated by the air current and the centrifugal force exerted thereon. Thus, the needles of the metallic card clothing function rather to force them into the top card clothing 10 than to deliver them thereto. As the result, the fibers on the cylinder roller 7 are carded and only long fibers are carried forth. By the time the web of fibers reaches the doffer roller 8, therefore, it is held on the surface of the cylinder roller 7 in a thoroughly opened state. Subsequently, the fibers held on the surface of the cylinder roller 7 are passed over onto the doffer roller 8. Now, this operation will be described below with reference to FIG. 16 and FIG. 17. In FIG. 15, 12, 13, 14, and 15 each denote a cover and the flow indicated by dotted lines represents a path for the air current.

Figure 16:
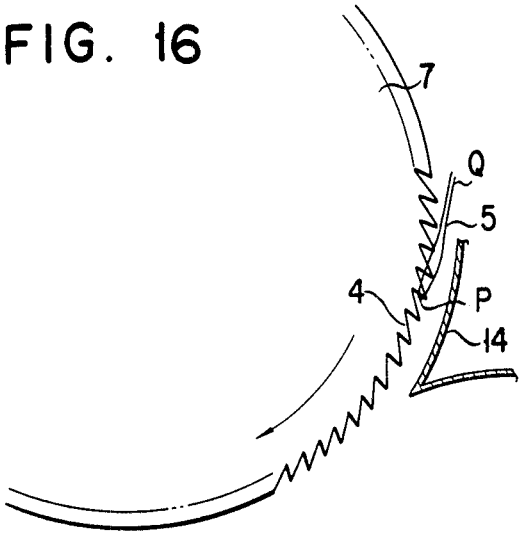
FIG. 16 is a schematic explanatory diagram for illustrating the interaction generated between the needle and fibers on the surface of a cylinder roller.
Figure 17:
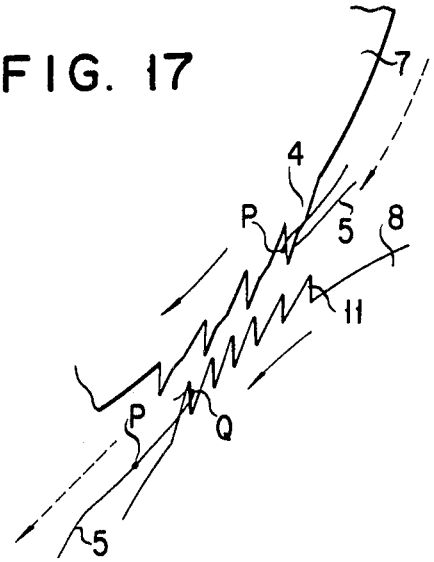
FIG. 17 is a schematic explanatory diagram for illustrating the interaction generated between the cylinder roller and the doffer roller.

Before the fiber held fast on the surface of the cylinder roller 7 approaches the doffer roller 8, the distance between the cylinder roller 7 and the cover 14 is relatively large and the speed of the current of air is equal to the speed of the cylinder roller 7 on the surface of the cylinder roller 7 and this speed decreases in proportion as the aforementioned distance increases. As the fiber on the cylinder roller 7 approaches the doffer roller 8, it will verge on entering the narrow opening between the cylinder roller 7 and the doffer roller 8 (FIG. 15). As the result, the air current which has had a large flow volume is now compelled to pass through the narrowed opening between the cylinder roller 7 and the doffer roller 8. During this passage, the speed of the air current naturally increases (because the space below the zone of interaction between the cylinder roller 7 and the doffer roller 8, namely, the space on the outgoing side for the air current, is placed under negative pressure). The fiber 5 on the surface of the cylinder roller 7 is carried forward, with the point P near the central part thereof caught on the needle 4 of the cylinder roller and the terminals thereof buoyant as illustrated in FIG. 16 until it reaches the doffer roller 8. As it approaches the doffer roller 8, the air current (indicated by the arrow of dotted lines) abruptly increases its speed and seeks to force its way between the cylinder roller 7 and the doffer roller 8, with the result that the air current blows the fiber 5 up rearwadly. The fiber 5 has the terminal part Q thereof caught on the needle 11 of the doffer roller 8 as illustrated in FIG. 17 and, at the same time, the fiber on the cylinder roller 7 is caused to float up as a whole. Even the folded portion of the fiber is straightened out by the force of the air current and the interacting force of the opposed needles. Thus, the fiber is passed over onto the surface of the doffer roller 8 in an opposite direction relative to the direction in which the fiber has been held fast on the cylinder roller 7. In this case, short fibers and impurities held down between the rows of needles are completely released because the acting angles in the basal portions of the acting surfaces of the needles have a triangular cross-sectional shape. They are then made to fall down the roller by the action of the air current. Denoted by 18 is a fly comb.

When the metallic card clothing of this invention is used as described above, since the action of the cylinder roller is vigorous and the fibers are produced in a thoroughly opened state, there is no possibility of the quality of the product of carding being degraded even when the ratio of transfer of fibers from the cylinder roller to the doffer roller is amply heightened.

Even when the needles of the metallic card clothing are used as the needles on the doffer roller, they are enabled to take hold of a large volume of fibers by being given a sufficiently acute acting angle and a sufficiently large length. (Heretofore, use of needles of this sort has often entailed degradation of quality of the product of carding because they take up insufficiently opened fibers excessively.)

In the transfer of fibers, when the needles of the cylinder roller have a shape according with the present invention, the fibers are very smoothly separated from the cylinder roller owing to the aforementioned action of the air current. Thus, the fibers suffered to remain on the cylinder roller are very few. Further, since the needles on the cylinder roller are capable of perfectly taking hold of the web of fibers delivered by the taker-in roller, they serve to decrease the amount of fibers suffered to fall down during the transfer.

The metallic card clothing of the present invention can be used as effectively on other rollers as on the aforementioned cylinder roller. It is optional to form the needles of the shape contemplated by this invention directly on a metallic cylinder or roller.

In the metallic card clothing of the present invention, the serrated component elements have a triangular shape in a plane (acting surface) as viewed in the direction of travel of the card clothing and a lateral shape resembling the teeth of a saw as described above, the acting angle of the needles is quite powerful. Further, by making the most of the effect of the edge line of the needles, the needles of the metallic card clothing used on the cylinder roller are enabled to interact vigorously with the needles on the taker-in roller, the walker roller, and top card clothing, etc. and the transfer of fibers from the cylinder roller to the doffer roller is facilitated to a great extent, and the improvement in the quality of the product of carding, the improvement of yield, and the improvement of productivity are allowed to be achieved advantageously. Since the metallic card clothing of the present invention can be manufactured simply by digging up at fixed intervals one projected ridge or a plurality of regularly spaced projected ridges formed on one flat surface of a steel strip, the otherwise inevitable loss of material is completely eliminated and the manufacture itself is accomplished very easily and quite inexpensively. Moreover, the metallic card clothing enables a desired increase in production to be attained without entailing any appreciable alteration in the carding machine. A particularly noteworthy advantage of the metallic card clothing of this invention resides in the fact that since the serrated component elements are formed by digging up the steel strip containing fibrous carbide segments as the source for resistance to wear (unlike the card clothing which is formed by the punching liable to severe the fibrous carbide segments arranged in the longitudinal direction), the fibers under treatment act on the needles substantially perpendicularly to the direction of arrangement of the fibrous carbide segments. Consequently, the metallic card clothing of this invention enjoys notably high resistance to wear as compared with the conventional countertype.

What is claimed is:

1. A metallic card clothing comprising a base portion and a plurality of upwardly extending needles regularly spaced, one after the other in the direction of needle advance, each of said needles comprising an upwardly projecting ridge having side walls sloping upwardly and inwardly from said base portion and merging at the outward peak of said ridge and forming a ridge line extending longitudinally in the direction of needle advance, said upwardly projecting ridge and said outward peak ridge line being raised at equal intervals longitudinal of said ridge line and the direction of movement of said needle advance and forming serrated elements extending upwardly from said ridge line, each of said serrated elements having a triangular shaped acting surface with a flat face forwardly in the direction of needle advance and forming an acute angle acting surface relative to said base portion and triangular shaped rear surfaces extending upwardly from said ridge, said triangular shaped acting surface and said triangular shaped rear surfaces on each of said serrated elements merging to form a point at the outer end of said each serrated element.

2. A metallic card clothing according to claim 1 in which the base portion of said serrated element inwardly of said acute angle acting surface forms an obtruse angle relative to said base portion.

3. A metallic card cloth according to claims 1 or 2, wherein said base portion further includes a plurality of upwardly extending needles regularly spaced transverse the direction of needle advance to said plurality of needles regularly spaced in the direction of needles advance.

* * * * *